US008505707B2

(12) United States Patent
Iwami

(10) Patent No.: US 8,505,707 B2
(45) Date of Patent: Aug. 13, 2013

(54) MONEY HANDLING MACHINE

(75) Inventor: Toyofumi Iwami, Hyogo (JP)

(73) Assignee: Glory Ltd., Himeji-shi, Hyogo (JP)

( * ) Notice: Subject to any disclaimer, the term of this patent is extended or adjusted under 35 U.S.C. 154(b) by 246 days.

(21) Appl. No.: 12/736,252

(22) PCT Filed: Mar. 26, 2008

(86) PCT No.: PCT/JP2008/055712
§ 371 (c)(1),
(2), (4) Date: Nov. 2, 2010

(87) PCT Pub. No.: WO2009/118838
PCT Pub. Date: Oct. 1, 2009

(65) Prior Publication Data

US 2011/0048891 A1 Mar. 3, 2011

(51) Int. Cl.
*G07F 7/04* (2006.01)

(52) U.S. Cl.
USPC ..... 194/206

(58) Field of Classification Search
USPC ..... 194/206, 344, 350; 53/399; 235/379; 209/534; 902/8, 9, 10, 11, 12, 13, 14, 15, 902/17, 22
See application file for complete search history.

(56) References Cited

U.S. PATENT DOCUMENTS 5,468,941 A * 11/1995 Sasaki ..... 235/379

FOREIGN PATENT DOCUMENTS

| | | | |
|---|---|---|---|
| JP | 08-096216 | | 4/1996 |
| JP | 08-096216 | A * | 4/1996 |
| JP | 08-96216 | A * | 4/1996 |
| JP | 10-105776 | | 4/1998 |
| JP | 10-105776 | A * | 4/1998 |
| JP | 2000-099793 | | 4/2000 |
| JP | 2000-099794 | | 4/2000 |
| JP | 2000-099794 | A * | 4/2000 |
| JP | 2002-024898 | | 1/2002 |
| WO | WO 2008/030356 | A1 | 3/2008 |

OTHER PUBLICATIONS

PCT International Preliminary Report on Patentability (dated Nov. 9, 2010—7 pages), PCTJP2008055712.
Supplementary European Search Report (8 pages—dated Mar. 14, 2011), PCT/JP2008055712.
EPO Office Action (Application No. 08 738 900.3) (4 pages—dated Dec. 13, 2012).

* cited by examiner

*Primary Examiner* — Mark Beauchaine
(74) *Attorney, Agent, or Firm* — Renner, Kenner, Greive, Bobak, Taylor & Weber

(57) ABSTRACT

A money handling machine (1) according to the present invention includes a hopper (3) from which money is inputted, a money output port (8, 18) from which money is outputted, a recognition unit (5) which recognizes the denomination of the money inputted from the hopper (3), a bundled money storage chamber (35) provided solely for 100-yuan banknotes as a first denomination, a loose money storage chamber (9) which stores money in a loose state, a to-be-bundled money stacking section (15, 16), and a bundling device (17). The 100-yuan banknotes recognized by the recognition unit (5) are transported directly to the to-be-bundled money stacking section (15, 16) through a transport path, bundled into a batch by the bundling device (17), and stored in the bundled money storage chamber (35).

3 Claims, 4 Drawing Sheets

MONEY HANDLING MACHINE

TECHNICAL FIELD

The present invention relates to a money handling machine configured such that money (coins and banknotes) is sorted by kind (denomination), stored therein, and dispensed therefrom.

BACKGROUND ART

Money handling machines serving as teller machines for receiving and dispensing money are used in financial institutions and the like. In a money handling machine of this type, collected money is taken in from a money input port, recognized, sorted by denomination, and stored. At this time, abundantly circulated banknotes such as Chinese 100-yuan banknotes are bundled into batches of 100 banknotes.

A banknote handling machine disclosed in Patent Document 1 includes storage chambers for respective denominations to be handled, and is configured such that banknotes inputted into the machine are stored in the storage chambers by denomination. When the number of banknotes in any of the storage chambers becomes greater than a predetermined number, the banknotes are transported to a bundling unit, and bundled into a batch. Further, the mode is switched so that banknotes of a specific denomination inputted into the machine can be transported directly to the bundling unit and bundled into a batch without temporary storage in the corresponding storage chamber.

Patent Document 1: JP-A-H10(1998)-105776

DISCLOSURE OF THE INVENTION

Problem to be Solved by the Invention

The banknote handling machine disclosed in Patent Document 1 proposes to include an arrangement such that the operation mode is switched to handle a greater number of banknotes of the specific denomination inputted into the machine by transporting the banknotes of the specific denomination directly to the bundling unit and bundling the banknotes into a batch without transporting the banknotes into any of the denomination-specific storage chambers for reduction of process time.

In the banknote handling machine disclosed in Patent Document 1, however, the operation mode is simply switched for the handling of the specific denomination. Therefore, reduction in the overall size of the machine is impossible.

That is, the storage chambers having the same structure are provided for the respective denominations to be handled, and the money handling method is changed only for the specific denomination by switching the operation mode. Thus, mechanisms and functions are not properly designed for each of the denominations, so that the machine includes unnecessary mechanisms and unnecessary functions. This leaves room for improvement in costs and spatial arrangement.

It is an object of the present invention to provide a small-size and compact money handling machine capable of properly performing a money handling process to solve the problem associated with the prior art.

It is another object of the present invention to provide a money handling machine which has functions to be frequently used for each denomination with a minimum number of unnecessary functions, and is capable of efficiently performing a money handling process.

It is further another object of the present invention to provide a money handling machine capable of performing a money output operation in a manner that satisfies a user's demand.

Means for Solving the Problem

A money handling machine (1) according to the present invention includes: a money input port (3) from which money is inputted; a money output port (8, 18) from which money is outputted; a recognition unit (5) which recognizes a denomination of the money inputted from the money input port; a bundled money storage chamber (35) provided solely for a first denomination; a loose money storage chamber (9*c*, 9*d*, 9*e*) provided for a second denomination; a bundling unit (15, 16, 17) which bundles a predetermined number of money into a batch; a transport path (6, 20 to 27) through which the money inputted from the money input port is transported to the recognition unit, the loose money storage chamber, the bundled money storage chamber, the bundling unit and the money output port; first input money handling means (51, S2, S8 to S12) which transports money recognized as the first denomination by the recognition unit (5) to the bundling unit through the transport path and transports a batch of money of the first denomination bundled by the bundling unit to the bundled money storage chamber through the transport path; and second input money handling means (51, S2 to S4, S6, S7) which transports money recognized as the second denomination by the recognition unit (5) to the loose money storage chamber through the transport path.

Parenthesized alphanumeric characters in this section correspond to reference characters of respective components in an embodiment to be described later, but do not intend to limit the scope of the present invention.

With the aforementioned arrangement, the bundled money storage chamber (35) is provided solely for the first denomination in the money handling machine (1). That is, the money handling machine includes components which vary depending on the denomination. Thus, the machine is efficiently constructed so that necessary components can be employed in different combinations for the respective denominations to be handled according to the amount of money of each of the denominations.

Further, the money of the first denomination is bundled into a batch by the bundling unit (15, 16, 17) and transported to the bundled money storage chamber (35), while the money of the second denomination is transported to the loose money storage chamber (9*c*, 9*d*, 9*e*). Thus, the money handling process can be optimized according to the denomination of the inputted money, so that the inputted money can be speedily sorted and stored. In addition, it is possible to prepare for dispensing money.

The inventive money handling machine (1) may further include output money handling means (51, S27, S28) which takes out a batch of money of the first denomination from the bundled money storage chamber (35), and takes out money of the second denomination from the loose money storage chamber (9*c*, 9*d*, 9*e*) and causes the bundling unit (15, 16, 17) to bundle the money of the second denomination taken out of the loose money storage chamber into a batch in response to input of a money output command.

With the aforementioned arrangement, the money of the first denomination and the money of the second denomination can be dispensed in a bundled state from the money handling machine (1). Thus, the money handling machine is suitable for dispensing a large amount of money. In this case, for example, money of the abundantly circulated first denomination (e.g., Chinese 100-yuan banknotes) is bundled into a batch after it is inputted into the machine, and prepared for the dispensing of the money. Thus, the money of the abundantly circulated denomination can be speedily dispensed in the bundled state in response to the input of the money output command. This reduces the process time required for dispensing the money of the abundantly circulated denomination, so that the money handling machine is excellent in operability.

The inventive money handling machine (1) may further include a loose first-denomination money storage chamber (9*b*) provided for the first denomination, and third input money handling means (S8, S13) which transports the money recognized as the first denomination by the recognizing unit (5) into the loose first-denomination money storage chamber (9*b*) through the transport path (6, 26) in response to a predetermined command.

With the aforementioned arrangement, the loose first-denomination money storage chamber (9*b*) is provided in addition to the bundled money storage chamber (35) for the first denomination. Thus, even the money of the abundantly circulated first denomination, for example, can be dispensed in a small amount. This makes the money handling machine more convenient.

The inventive money handling machine (1) may further include a money output operation portion (52, 524) to be operated to designate whether money is to be dispensed in a bundled state or in a loose state when the money output command is inputted. The output money handling means may cause the money taken out of the loose money storage chamber selectively to pass through the bundling unit or to bypass the bundling unit in response to the designation made on the money output operation portion.

With the aforementioned arrangement, the money of the second denomination taken out of the loose money storage chamber (9*c*, 9*d*, 9*e*) is dispensed selectively in the loose state or in the bundled state. Therefore, the money output process can be performed according to the amount of the money to be dispensed.

In the inventive money handling machine (1), the first input money handling means may feed out money of the first denomination from the loose first-denomination money storage chamber (9*b*) when the number of the money transported to the bundling unit (15, 16) is less than the predetermined number, and causes the bundling unit (17) to bundle the predetermined number of money into a batch, which is in turn transported to the bundled money storage chamber (35).

With the aforementioned arrangement, if the number of the inputted money of the first denomination is less than the predetermined number for the bundling, such an odd number of money is not left in the bundling unit (15, 16) as they are, but complemented with a complementary number of money fed out of the loose first-denomination money storage chamber (9*b*). Then, the resulting predetermined number of money is bundled. Thus, the machine can more conveniently process and handle the money of the first denomination.

The inventive money handling machine (1) may further include returning means (S15, S16) which returns the inputted money of the first denomination in the bundled state from the bundled money storage chamber (35) in response to cancellation of the input of the money of the first denomination.

With the aforementioned arrangement, money inputted in a loose state to the money handling machine (1) is returned in the bundled state. Thus, an operator can receive the once inputted money in the bundled state, and easily confirm the number of the money. Therefore, the machine is convenient when a large amount of money is inputted into the machine.

The first denomination may include a single denomination (e.g., Chinese 100-yuan banknotes) or, alternatively, may include a plurality of denominations (two or three abundantly circulated denominations, e.g., Chinese 100-yuan banknotes and 50-yuan banknotes, or Japanese 10,000-yen banknotes and 1,000-yen banknotes). Where the first denomination includes the plurality of denominations, a corresponding number of bundled money storage chambers (35) may be provided for the respective denominations.

DESCRIPTION OF REFERENCE CHARACTERS

Figure 1:
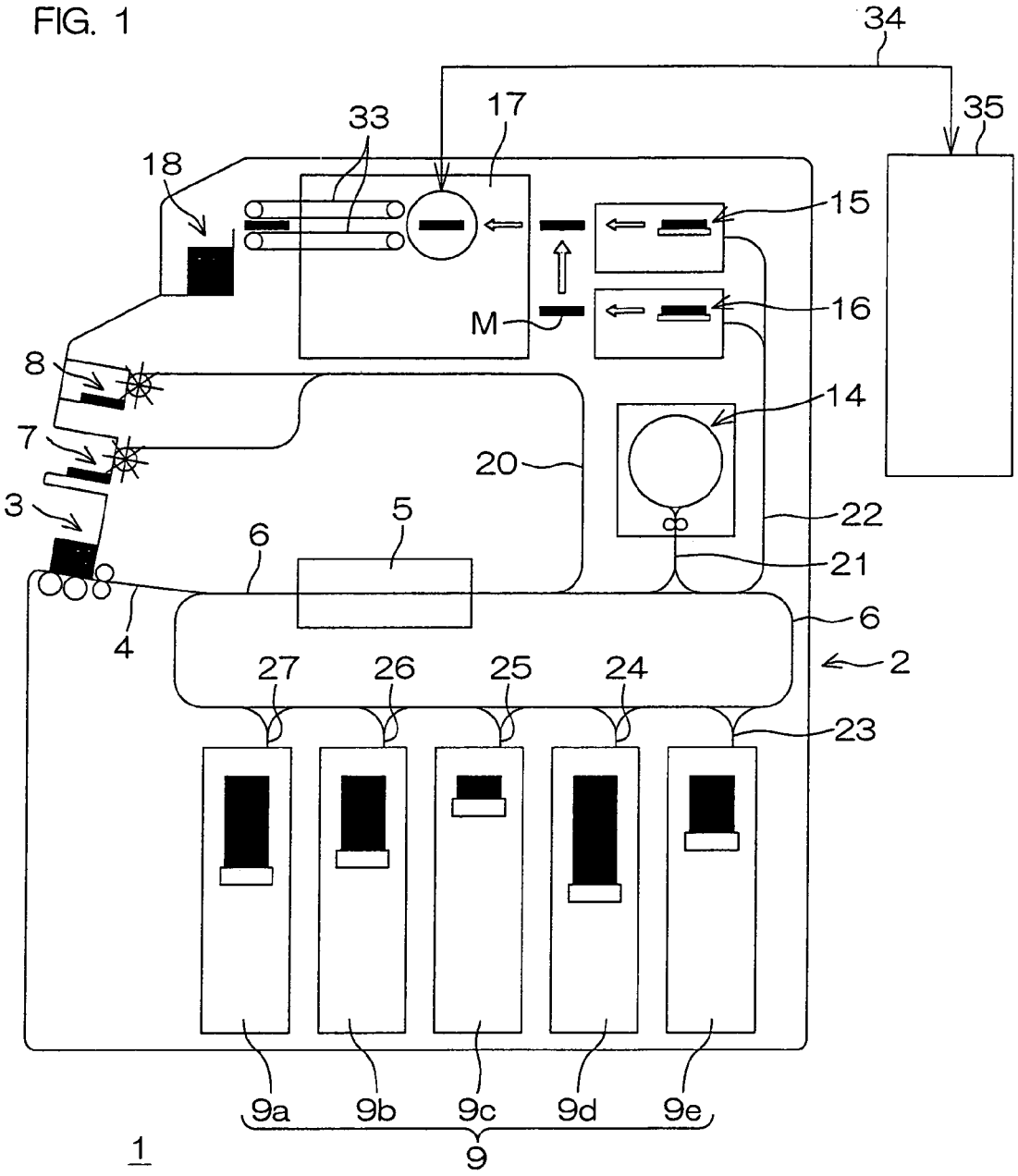
FIG. 1 is a schematic vertical sectional view showing the overall construction of a banknote handling machine 1 according to one embodiment of the present invention.

1: Banknote handling machine
3: Hopper (money input port)
5: Recognition unit
6: Transport path
8: Money output port
9, 9*a*, 9*b*, 9*c*, 9*d*, 9*e*: Loose banknote storage chambers (banknote storage chamber)
14: Escrow unit
15, 16: To-be-bundled banknote stacking sections
17: Bundling device
18: Banknote batch output port
20, 21, 22, 23, 24, 25, 26, 27: Branch paths
34: Batch transport path
35: Bundled banknote storage chamber
51: Control section

BEST MODE FOR CARRYING OUT THE INVENTION

With reference to the drawings, an embodiment of the present invention will hereinafter be described specifically.

Overview of Overall Construction

FIG. 1 is a schematic vertical sectional view showing the overall construction of a banknote handling machine 1 according to one embodiment of the present invention.

The banknote handling machine 1 is installed at a bank or the like, and serves as a teller machine for managing the depositing and the dispensing of banknotes.

Referring to FIG. 1, the banknote handling machine 1 includes a housing 2. The left-hand side of FIG. 1 corresponds to the front side of the housing 2. A hopper 3 serving as a money input port for inputting a banknote, a money output port 8 having an opening to be covered and uncovered with a shutter, a rejected-note outlet port 7, and a banknote batch output port 18 are provided in a front portion of the housing 2.

An feed-in path 4, a recognition unit 5, a transport path 6, five banknote storage chambers (hereinafter referred to as "loose banknote storage chambers") 9 (9*a*, 9*b*, 9*c*, 9*d* and 9*e* from the left side when being distinguished from each other), an escrow unit 14, two to-be-bundled banknote stacking sections 15, 16 and a bundling device 17 are provided in the housing 2.

The feed-in path 4 is a path through which banknotes set in the hopper 3 are taken in one by one and fed to the transport path 6.

The recognition unit 5 determines the denomination, the fitness, the authenticity and the like of each of the banknotes transported through the transport path 6. Further, the recognition unit 5 detects whether each of the banknotes is transported in a face-up state or in a face-down state.

The transport path 6 serves to transport the banknotes each recognized by the recognition unit 5. The transport path 6 is looped, so that the banknotes can be circulated through the transport path 6. The recognition unit 5 is disposed in the transport path 6. Downstream of the recognition unit 5 with respect to a banknote transport direction (a clockwise direction in FIG. 1) in the transport path 6, one-side ends of branch paths 20, 21, 22, 23, 24, 25, 26, 27 are connected to the transport path 6 in this order.

The other end of the branch path 20 is connected to the rejected-note outlet port 7 or the money output port 8. The other end of the branch path 21 is connected to the escrow unit 14, and the other end of the branch path 22 is connected to the to-be-bundled banknote stacking section 15 or 16. The other end of the branch path 23 is connected to the loose banknote storage chamber 9*e*, and the other end of the branch path 24 is connected to the loose banknote storage chamber 9*d*. The other end of the branch path 25 is connected to the loose banknote storage chamber 9*c*, and the other end of the branch path 26 is connected to the loose banknote storage chamber 9*b*. The other end of the branch path 27 is connected to the loose banknote storage chamber 9*a*.

Diverters (not shown) are respectively provided in junctures between the transport path 6 and the branch paths 20 to 27. In the transport path 6, the banknotes are each transported to a desired one of the branch paths 20 to 27 by switching the diverters.

Of the banknotes inputted from the hopper 3, a banknote recognized as a rejected note (a counterfeit note or the like) by the recognition unit 5 is transported from the transport path 6 to the branch path 20, and outputted to the rejected-note outlet port 7.

The banknotes, except for the rejected note, inputted from the hopper 3 pass through the branch path 21, and escrowed in the escrow unit 14. After the money input is accepted, the banknotes are each transported through one of the branch paths 23 to 27 according to denomination, and stored in a corresponding one of the loose banknote storage chambers 9. The banknotes of each denomination are taken out of the corresponding loose banknote storage chamber 9, and transported to the to-be-bundled banknote stacking section 15 or 16 from the transport path 6 through the branch path 22. A predetermined number of banknotes (e.g., 100 banknotes) stacked by denomination are bundled into a batch by the bundling device 17. The to-be-bundled banknote stacking sections 15 and 16, and the bundling device 17 collectively define a bundling unit. The batch of bundled banknotes is transported by transport belts 33, and outputted to the banknote batch output port. Alternatively, the batch of banknotes bundled by the bundling device 17 is transported to a bundled banknote storage chamber 35 through a batch transport path 34.

When the money input is cancelled, the banknotes escrowed in the escrow unit 14 are transported through the transport path 6 and the branch path 20, and returned from the money output port 8.

While the banknote handling process has thus been generally described, the setting of the banknote handling machine 1 may be changed to handle the banknotes in a desired manner as will be described later.

A mechanical feature of the banknote handling machine 1 according to this embodiment is that the bundled banknote storage chamber 35 is provided for a first denomination defined as a specific denomination (e.g., abundantly circulated Chinese 100-yuan banknotes as the first denomination or the specific denomination if the bank note handling machine 1 is used, for example, at a bank in China). The bundled banknote storage chamber 35 is dedicated to the 100-yuan banknote batches, and there is no bundled banknote storage chamber for banknotes of the other denominations. Thus, the banknote handling machine 1 includes such a unique mechanical arrangement provided solely for the banknotes of the first denomination (e.g., 100-yuan banknotes). In other words, the same arrangements are not provided for the respective denominations to be handled, but the banknote handling machine 1 includes the arrangement dedicated to the banknotes of the specific denomination. Thus, a large number of banknotes of the specific denomination (e.g., 100-yuan banknotes) can be efficiently handled. This improves the overall work efficiency of the machine without provision of unnecessary functions for the other denominations.

The first denomination is not limited to a single denomination (i.e., 100-yuan banknotes), but may include two abundantly circulated denominations (e.g., 100-yuan banknotes and 50-yuan banknotes). In this case, two bundled banknote storage chambers 35 are provided for the 100-yuan banknotes and the 50-yuan banknotes.

In FIG. 1, the bundled banknote storage chamber 35 is illustrated as a schematic block, but actually disposed in a rear portion of the housing 2. The 100-yuan banknotes bundled by the bundling device 17 are transported rearward perpendicularly to the paper face of FIG. 1, and stored in the bundled banknote storage chamber 35 disposed in the rear portion of the housing 2.

It is herein assumed that the banknote handling machine 1 is used, for example, at a bank in China. Of the five loose banknote storage chambers 9*a* to 9*e*, the loose banknote storage chamber 9*a* serves to collectively store banknotes (denomination-nonspecific loose banknote storage chamber), and the loose banknote storage chamber 9*b* serves to store 100-yuan banknotes. The loose banknote storage chamber 9*c* serves to store 50-yuan banknotes, and the loose banknote storage chamber 9*d* serves to store 20-yuan banknotes. Further, the loose banknote storage chamber 9*e* serves to store 10-yuan banknotes.

In this embodiment, the 50-yuan banknotes, the 20-yuan banknotes and the 10-yuan banknotes are of the second denomination, and the 100-yuan banknotes are of the first denomination. Thus, the loose banknote storage chambers 9*b* to 9*e* are provided for the respective banknote denominations irrespective of the first denomination and the second denomination.

Control Circuit Block

Figure 2:
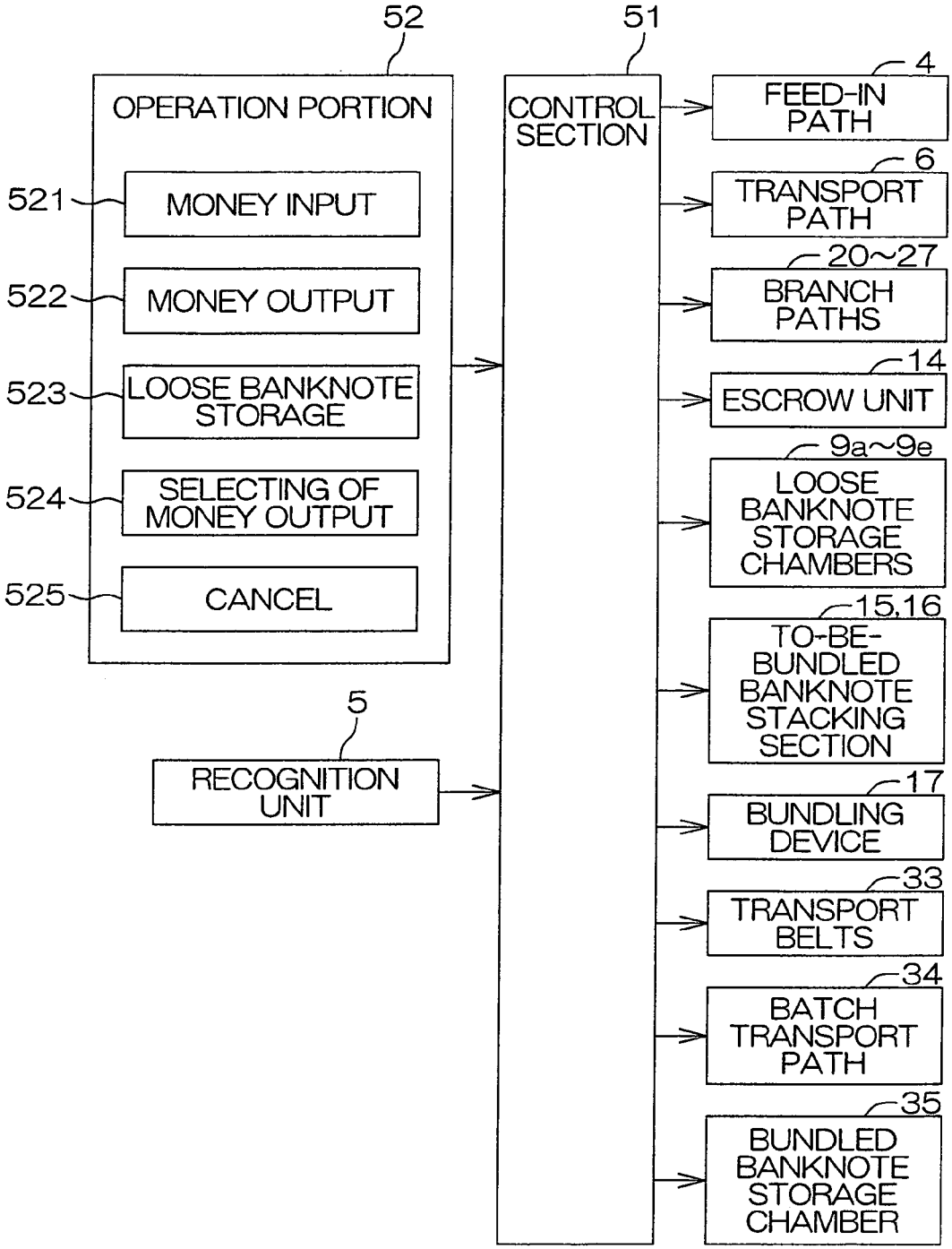
FIG. 2 is a block diagram showing the configuration of a control circuit of the banknote handling machine 1.

FIG. 2 shows a block diagram of a control circuit of the banknote handling machine 1 according to the embodiment of the present invention. The banknote handling machine 1 includes a control section 51 serving as a control center and including a microcomputer and the like. The banknote handling machine 1 further includes an operation portion 52 to be operated by an operator (e.g., a bank clerk if the banknote handling machine 1 is installed at a bank). When the operation portion 52 is operated, an operation signal is applied to the control section 51. The operation portion 52 includes, for example, a money input key 521, a money output key 522, a loose banknote storage setting key 523, a money output selecting key 524, a cancel key 525 and the like.

Recognition information of a banknote recognized by the recognition unit 5 is also applied to the control section 51.

In response to an input applied from the operation portion 52 and the recognition unit 5, the control section 51 controls the driving and the operation of the feed-in path 4, the transport path 6, the branch paths 20 to 27, the escrow unit 14, the loose banknote storage chambers 9*a* to 9*e*, the to-be-bundled banknote stacking sections 15 and 16, the bundling device 17, the transport belts 33, the batch transport path 34 and the bundled banknote storage chamber 35.

Money Input Control Operation

Figure 3:
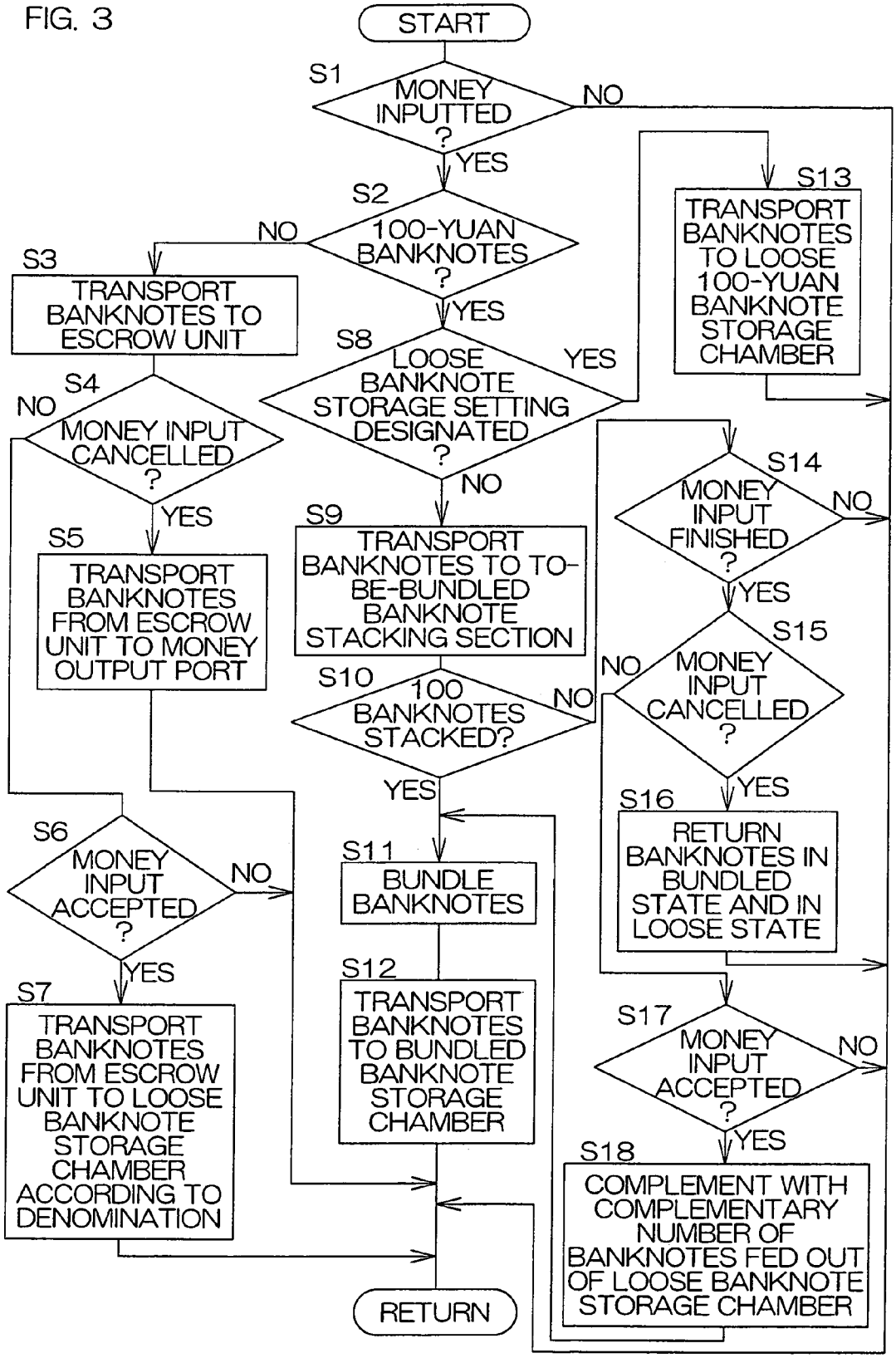
FIG. 3 is a flowchart showing an exemplary money input control operation.

FIG. 3 is a flowchart showing an exemplary money input control operation to be performed by the control section 51 of FIG. 2 in the banknote handling machine 1.

With reference to FIGS. 1 and 2, the money input control operation to be performed in the banknote handling machine 1 will be described according to the flowchart of FIG. 3.

The control section 51 judges whether money is inputted (Step S1). If the operator stacks collected banknotes in the hopper 3 and presses the money input key 521, the control section 51 determines that the money is inputted, and drives the feed-in path 4. Thus, the banknotes stacked in the hopper 3 are sequentially taken into the machine one by one. The banknotes taken into the machine are sequentially transported to the recognition unit 5, which determines the denomination, the fitness, the authenticity and the like of each of the banknotes.

Based on a recognition signal applied from the recognition unit 5, the control section 51 judges whether the banknote taken into the machine is a 100-yuan banknote (Step S2). That is, it is judged whether the banknote taken into the machine is of the first denomination defined as the specific denomination. If it is determined that the banknote is not a 100-yuan banknote, the banknote is transported to the escrow unit 14 (Step S3).

When the control section 51 thereafter detects cancellation of the money input with the cancel key 525 being pressed by the operator (YES in Step S4), banknotes escrowed in the escrow unit 14 are transported to the money output port 8, and returned.

If the cancel key 525 is not pressed, the routine goes to Step S6 from Step S4, and the control section 51 judges whether the money input is accepted (Step S6). The money input is accepted, for example, after a lapse of a predetermined period from the finish of the money input or when a money input acceptance key (that is not shown, but may be provided, for example, on the operation portion 52) is operated. After the accepting of the money input, the banknotes escrowed in the escrow unit 14 are transported to one of the loose banknote storage chambers 9, more specifically, to the loose banknote storage chamber 9*c*, 9*d* or 9*e* in this embodiment. Thus, the banknotes are stored in one of the loose banknote storage chambers 9*c* to 9*e* by denomination (Step S7).

On the other hand, if the control section 51 determines in Step S2 that the banknote is the 100-yuan banknote of the first denomination (YES in Step S2), the control section 51 subsequently judges whether a loose banknote storage setting is designated (Step S8). The designation of the loose banknote storage setting is achieved by pressing the loose banknote storage setting key 523 on the operation portion 52. If the loose banknote storage setting key 523 is not pressed by the operator, the control section 51 determines that the loose banknote storage setting is not designated (NO in Step S8), and transports the 100-yuan banknote to the to-be-bundled banknote stacking section 15 or 16 (Step S9).

Then, the control section 51 judges whether a predetermined number of 100-yuan banknotes (e.g., 100 sheets of 100-yuan banknotes) are stacked in the to-be-bundled banknote stacking section 15 or 16 (Step S10). If 100 sheets of 100-yuan banknotes are stacked, the stacked 100 sheets of 100-yuan banknotes are transported to the bundling device 17, and bundled into a batch (Step S11). The batch of 100-yuan banknotes thus bundled is transported from the batch transport path 34 to the bundled banknote storage chamber 35, and stored in the bundled banknote storage chamber 35 (Step S12).

If it is determined in Step S8 that the loose banknote storage setting is designated with the loose banknote storage setting key 523 being pressed by the operator (YES in Step S8), the 100-yuan banknotes are transported to neither the to-be-bundled banknote stacking section 15, 16 nor the escrow unit 14, but transported to the loose 100-yuan banknote storage chamber 9*b*, and stored in the loose banknote storage chamber 9*b* (Step S13). Where the loose banknote storage setting is designated, the 100-yuan banknotes may be transported to the escrow unit 14 for escrow thereof and then transported to the loose 100-yuan banknote storage chamber 9*b* for storage thereof, rather than performing the aforementioned operation.

If the number of the 100-yuan banknotes stacked in the to-be-bundled banknote stacking section 15 or 16 is less than 100 in Step S10, it is judged whether the money input is finished (Step S14). That is, when a large number of 100-yuan banknotes are inputted and several batches of bundled 100-yuan banknotes are created and stored in the bundled banknote storage chamber 35, the number of the 100-yuan banknotes inputted from the hopper 3 is not always an integral multiple of 100. For this reason, there is a possibility that the money input is finished with less than 100 sheets of 100-yuan banknotes (an odd number of 100-yuan banknotes, i.e., 1 to 99 sheets of 100-yuan banknotes) being stacked in the to-be-bundled banknote stacking section 15 or 16.

If the control section 51 determines that the money input is finished with less than 100 sheets of 100-yuan banknotes being stacked in the to-be-bundled banknote stacking section 15 or 16, the control section 51 further judges whether the money input is cancelled (Step S15). If it is determined that the money input is cancelled after the finish of the money input, the inputted 100-yuan banknotes are returned (Step S16). Where the number of the inputted 100-yuan banknotes is not less than 100, the 100-yuan banknotes are fed out by the hundred in a bundled state from the bundled banknote storage chamber 35, and returned in the bundled state. Further, less than 100 sheets of 100-yuan banknotes are fed out of the loose 100-yuan banknote storage chamber 9*b*, and returned to the money output port 8. In this case, where the 100-yuan banknotes are escrowed in the escrow unit 14 to be stored in a loose state (in modification of Step S13), the 100-yuan banknotes are returned from the escrow unit 14.

When a large number of 100-yuan banknotes are inputted in a loose state and the money input is thereafter cancelled, the large number of 100-yuan banknotes inputted in the loose state are not returned in the loose state, but some of the 100-yuan banknotes are returned in a bundled state and an odd number of 100-yuan banknotes are returned in a loose state. Thus, the number of the returned 100-yuan banknotes can be easily checked, so that the machine is very convenient for the operator (bank clerk).

When it is determined in Step S15 that the money input is not cancelled, it is judged in Step S17 whether the money input is accepted. Like the judgment on the acceptance of the money input in Step S6, the judgment on the acceptance of the money input in Step S17 is affirmed, for example, after a lapse of the predetermined period from the finish of the money input or when the money input acceptance key is operated.

Upon the acceptance of the money input, the control section 51 complements the 100-yuan banknotes stacked in the to-be-bundled banknote stacking section 15 or 16 with a complementary number of 100-yuan banknotes fed out of the loose 100-yuan banknote storage chamber 9*b* to form a stack of 100 sheets of 100-yuan banknotes (Step S18). After the complement, the total number of 100-yuan banknotes stacked in the to-be-bundled banknote stacking section 15 or 16 is 100. The 100 sheets of 100-yuan banknotes are transported to the bundling device 17, and bundled into a batch (Step S11). The batch of 100 sheets of 100-yuan banknotes is transported to the bundled banknote storage chamber 35, and stored in the bundled banknote storage chamber 35 (Step S12).

In this embodiment, if an odd number 100-yuan banknotes or less than a predetermined number of 100-yuan banknotes (less than 100 sheets of 100-yuan banknotes) are left in the to-be-bundled banknote stacking section 15 or 16 after the acceptance of the money input, the odd number of 100-yuan banknotes are not left as they are, but complemented with a complementary number of 100-yuan banknotes fed out of the loose 100-yuan banknote storage chamber 9*b*. Then, the predetermined number of 100-yuan banknotes (e.g., 100 sheets of 100-yuan banknotes) are bundled into a batch. Therefore, the odd number of 100-yuan banknotes do not remain in either of the to-be-bundled banknote stacking sections, so that the to-be-bundled banknote stacking sections 15, 16 are ready for the subsequent money input or output. This arrangement is effective because the money input or output operation can be smoothly performed.

In the money input operation shown in FIG. 3, the loose banknote storage setting may be designated automatically rather than by the operator.

For example, the number of 100-yuan banknotes stored in the loose 100-yuan banknote storage chamber 9*b* is detected, and controlled to be always kept at not less than a predetermined number. More specifically, if the number of the 100-yuan banknotes stored in the loose banknote storage chamber 9*b* is less than the predetermined number, the loose banknote storage setting may be automatically designated. If the number of the 100-yuan banknotes stored in the loose banknote storage chamber 9*b* is not less than the predetermined number, the loose banknote storage setting may be automatically cancelled.

Money Output Control Operation

Figure 4:
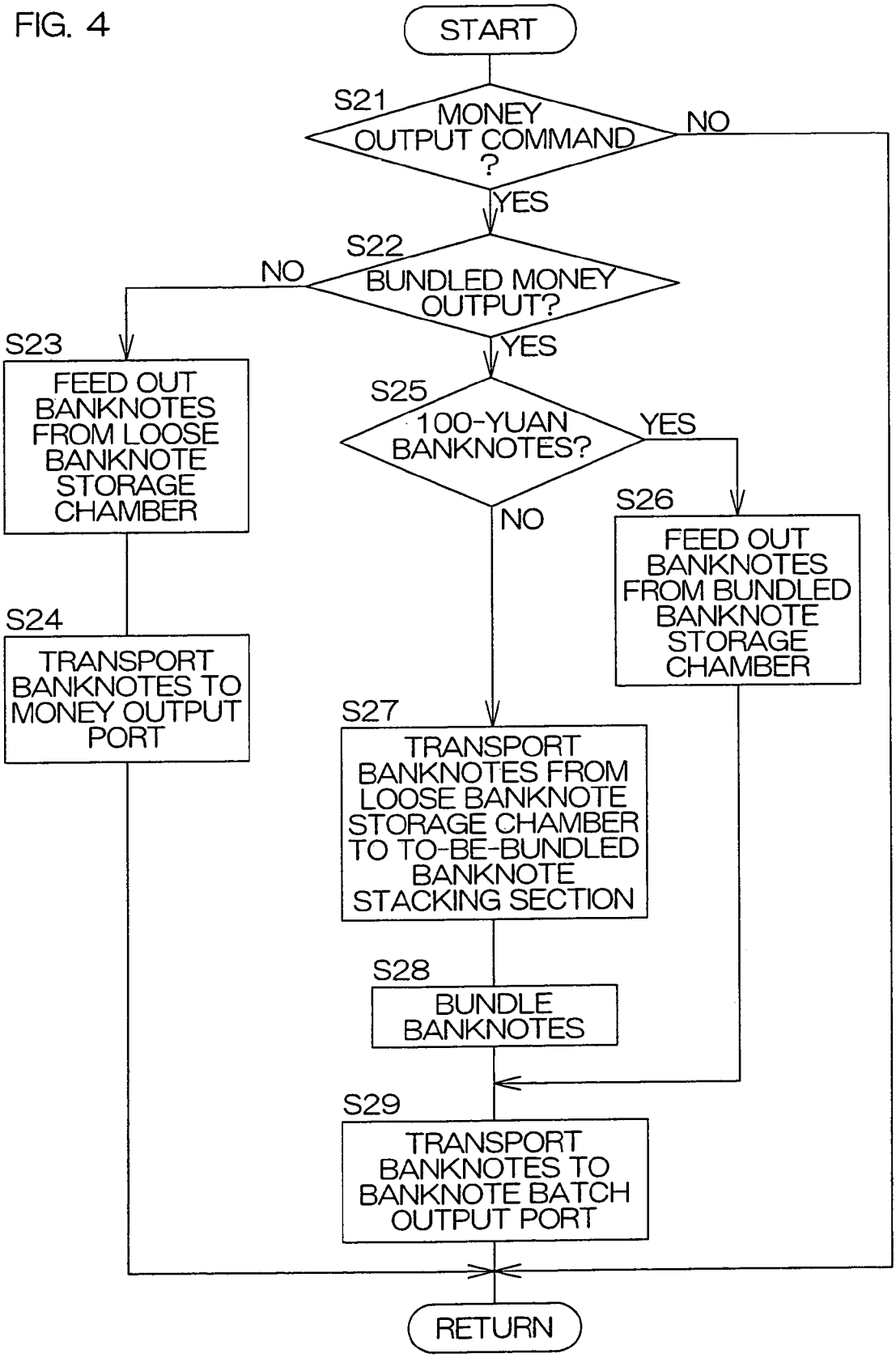
FIG. 4 is a flowchart showing an exemplary money output control operation.

FIG. 4 is a flowchart showing an exemplary money output control operation to be performed in the banknote handling machine 1.

When the money output key 522 on the operation portion 52 is operated by the operator, the control section 51 determines that a money output command is inputted (YES in Step S21). Then, the control section 51 judges whether banknotes are to be outputted in a bundled state or in an loose state (Step S22). The operator operates the money output selecting key 524 provided on the operation portion 52 to select either a bundled money output operation or a loose money output operation.

If the control section 51 determines that the bundled money output operation is not selected, i.e., the loose money output operation is selected (NO in Step S22), the control section 51 performs the money output operation by feeding out banknotes from any of the loose money storage chambers 9 (step S23) and transporting the banknotes to the money output port 8 (Step S24). Though not shown in this flowchart, the denominations and numbers of banknotes to be fed out of the corresponding loose banknote storage chambers 9 are determined based on the amount of the money to be outputted in the money output operation.

If it is determined in Step S22 that the bundled money output operation is selected (YES in Step S22), it is judged whether banknotes to be outputted are 100-yuan banknotes (Step S25). If the banknotes to be outputted are 100-yuan banknotes, the 100-yuan banknotes are fed out in the bundled state from the bundled banknote storage chamber 35 (Step S26), and outputted to the banknote batch output port 18 through the batch transport path 34 and the transport belts 33.

On the other hand, if the banknotes to be outputted are not 100-yuan banknotes (NO in Step S25), the banknotes are fed out in a loose state from the loose banknote storage chamber 9*c*, 9*d* or 9*e*, and transported to the to-be-bundled banknote stacking section 15, 16 (Step S27). If 100 banknotes are stacked, these banknotes are bundled into a batch by the bundling device 17 (Step S28). The batch of banknotes is transported to the banknote batch output port 18 by the transport belts 33, and outputted (Step S29).

In this embodiment, 100-yuan banknotes (banknotes of the first denomination defined as the specific denomination) are preliminarily bundled into batches, which are in turn stored in the bundled banknote storage chamber 35. Therefore, banknotes are fed out of the bundled money storage chamber 35 and outputted in the money output operation. This reduces the time required for outputting the 100-yuan banknotes in the bundled state.

On the other hand, banknotes of the second denomination such as 50-yuan banknotes, 20-yuan banknotes or 10-yuan banknotes are bundled into batches in response to demand for the bundled money output operation, and outputted. Therefore, the time required for the money output operation is somewhat increased. However, there is no need to preliminarily bundle the banknotes into batches and store the banknote batches, eliminating the need for provision of a bundled banknote storing space. This arrangement is advantageous because the size of the banknote handling machine 1 is not increased.

In the banknote handling machine 1 according to this embodiment, as described above, the same arrangement and the same handling method are not employed for the respective denominations to be handled, but different arrangements and different handling methods are employed for the respective denominations depending on the distribution amount or the handling amount of each denomination. More specifically, the arrangement for the banknotes of the first domination is different from the arrangement for the banknotes of the second domination. This makes it possible to speedily perform an optimum money handling process for each denomination. In addition, the machine has a unique effect such that it is free from size increase.

While the embodiment described above is directed to the handling of banknotes by way of example, the inventive machine is applicable to handling of coins. Where Japanese 1-yen coins, 5-yen coins, 10-yen coins, 50-yen coins, 100-yen coins and 500-yen coins are handled, for example, a bundled money storage chamber is provided for handling the 10-yen coins as the first denomination defined as the specific denomination, and only loose money storage chambers are provided for the other denomination coins as the second denomination. The second denomination may include two denominations including the 100-yen coins and the 10-yen coins.

The present invention is not limited to the embodiment described above, but various modifications may be made within the scope of the claims.

The invention claimed is:

1. A money handling machine for handling money, comprising:

a money input port from which money is inputted;

a money output port from which money is outputted;

a recognition unit which recognizes a denomination of the money inputted from the money input port;

a bundled money storage chamber provided solely for a first denomination;

a loose first-denomination money storage chamber provided for the first denomination;

a loose money storage chamber provided for a second denomination;

a bundling unit which bundles a predetermined number of money into a batch;

a transport path through which the money inputted from the money input port is transported to the recognition unit, the loose first-denomination money storage chamber, the loose money storage chamber, the bundled money storage chamber, the bundling unit and the money output port;

first input money handling means which transports money recognized as the first denomination by the recognition unit to the bundling unit through the transport path and transports a batch of money of the first denomination bundled by the bundling unit to the bundled money storage chamber through the transport path, at inputting of the first denomination;

second input money handling means which transports money recognized as the second denomination by the recognition unit to the loose money storage chamber through the transport path, at inputting of the second denomination;

third input money handling means which transports the money recognized as the first denomination by the recognition unit into the loose first-denomination money storage chamber through the transport path in response to a predetermined command;

output money handling means which feeds out a batch of money of the first denomination from the bundled money storage chamber, and feeds out money of the second denomination from the loose money storage chamber and causes the bundling unit to bundle the money of the second denomination fed out of the loose money storage chamber into a batch in response to input of a money output command; and a money output operation portion to be operated to designate whether money is to be dispensed in a bundled state or in a loose state when the money output command is inputted;

wherein the output money handling means causes the money of the second denomination fed out of the loose money storage chamber selectively to pass through the bundling unit or to bypass the bundling unit and feeds out the money of the first denomination selectively from the bundled money storage chamber or the loose first-denomination money storage chamber, in response to the designation made on the money output operation portion.

2. The money handling machine according to claim 1, wherein the first input money handling means feeds out money of the first denomination from the loose first-denomination money storage chamber when the number of the money transported to the bundling unit is less than the predetermined number, and causes the bundling unit to bundle the predetermined number of money into a batch, which is in turn transported to the bundled money storage chamber.

3. The money handling machine according to claim 1, further comprising returning means which returns inputted money of the first denomination in a bundled state from the bundled money storage chamber in response to cancellation of input of the money of the first denomination.

* * * * *